US006739821B2

(12) United States Patent
Levis-Thorne et al.

(10) Patent No.: US 6,739,821 B2
(45) Date of Patent: May 25, 2004

(54) VERTICAL CONVEYOR DEVICE FOR VARIOUS SIZED PAYLOADS

(75) Inventors: Ladd M. Levis-Thorne, Dedham, MA (US); Rick E. Morgan, Coral Springs, FL (US); Robert J. Lang, Davie, FL (US); Stephen B. Douglas, Boxborough, MA (US); Daniel J. McGuire, Pompano Beach, FL (US)

(73) Assignee: Autospace Holdings Corporation, Boston, MA (US)

( * ) Notice: Subject to any disclaimer, the term of this patent is extended or adjusted under 35 U.S.C. 154(b) by 0 days.

(21) Appl. No.: 10/192,858

(22) Filed: Jul. 11, 2002

(65) Prior Publication Data

US 2004/0007441 A1 Jan. 15, 2004

(51) Int. Cl.[7] ..... E04H 6/00
(52) U.S. Cl. ..... 414/234; 198/867.08
(58) Field of Search ..... 198/475.1, 681, 198/801, 802, 867.08, 803.11; 414/234, 235, 236, 237, 238

(56) References Cited

U.S. PATENT DOCUMENTS 3,675,759 A * 7/1972 Koppe ..... 198/867.08
3,884,371 A * 5/1975 Coira Castro ..... 414/234
5,374,149 A * 12/1994 Lichti ..... 414/234

FOREIGN PATENT DOCUMENTS

JP 5-133132 * 5/1993 ..... 414/234

* cited by examiner

*Primary Examiner*—James R. Bidwell
(74) *Attorney, Agent, or Firm*—Parkhurst & Wendel, L.L.P.

(57) ABSTRACT

A vertical conveyor device for accommodating motor vehicles of varying heights. Short and tall containers for motor vehicles alternate around a vertical carousel. When a container is placed in an accessible position, movable walkways and ramps change positions allowing patrons and vehicles easy access to the containers. The positions of the walkway and ramp vary depending on the heights of the containers and vehicles.

15 Claims, 7 Drawing Sheets

VERTICAL CONVEYOR DEVICE FOR VARIOUS SIZED PAYLOADS

FIELD OF THE INVENTION

The present invention relates to vertical conveyor devices. More specifically, the invention relates to a vertical conveyor device that can accommodate motor vehicles of varying heights.

BACKGROUND OF THE INVENTION

Urban congestion demands efficient land use.

Vertical storage devices for stacking and storing vehicles are known. Known systems include a series of platforms or containers that move in a circuit around an endless-loop type drive, or carousel. A location on the circuit serves as an access point. When a container reaches the access point, a vehicle can be either placed on or removed from the platform of the container. Then the container moves away and another platform may be accessed via the access point.

Previous patents disclose vertical storage devices for motor vehicles.

Lichti U.S. Pat. No. 5,374,149 discloses a vertical conveyor for storing and conveying automobiles. Here, an endless chain in the shape of a race track is mounted on a vertical frame and a plurality of platforms holding automobiles is connected to the chain and move about this race track frame. Lichti refined that conveyor system in U.S. Pat. No. 5,425,442.

Vita U.S. Pat. No. 5,980,185 discloses a vertical vehicle parking structure containing a means for coordinating the operation of the tower lift.

Zhang et al. U.S. Pat. No. 5,810,539 discloses a so-called maximum auto parking device. This patent claims a stopping hole on a car pan to position a vehicle. This reference also teaches strengthening rods for the car pans, a position for a parking power control box, and the use of balance weights to assist in moving a parking carousel.

The heights of passenger vehicles traditionally have been in a narrow range. Today, however, sport utility vehicles (SUV's) have come into fashion. Consequently, contemporary passenger vehicle heights vary greatly. For example, the year 2000 model Porsche 911 sports car has a height of only about 51.4 inches, while the year 2000 model Range Rover SUV has a height of about 71.6 inches.

Presently, vertical conveyor systems either accept exclusively compact cars, thereby excluding SUV's, or accommodate most vehicle heights, thereby wasting precious space, because the heights of all vehicle containers are identical.

SUMMARY OF THE INVENTION

It is an object of the present invention to provide a vertical storage device to accommodate vehicles of varying sizes, by providing various sized storage containers with an adaptable means of vehicle access.

It is a further object of the present invention to provide a walkway that can accommodate storage containers having platforms at varying heights, thereby providing safe access to the containers. The movable walkway allows free rotation of the platforms, and access by physically impaired patrons.

Another object of the present invention is to provide an improved pan that self-bails accumulated rainwater and vehicle fluids.

It is yet another object of the present invention to provide a lateral tire guidance system, thereby assuring proper location of vehicles upon the platforms.

The present invention relates to a vertical vehicle storage device that efficiently accommodates motor vehicles of various heights.

BRIEF DESCRIPTION OF THE DRAWINGS

Other objects and further features of the advantageous vertical conveyor device of the present invention are illustrated by the accompanying drawings wherein.

DETAILED DESCRIPTION

Figure 1:
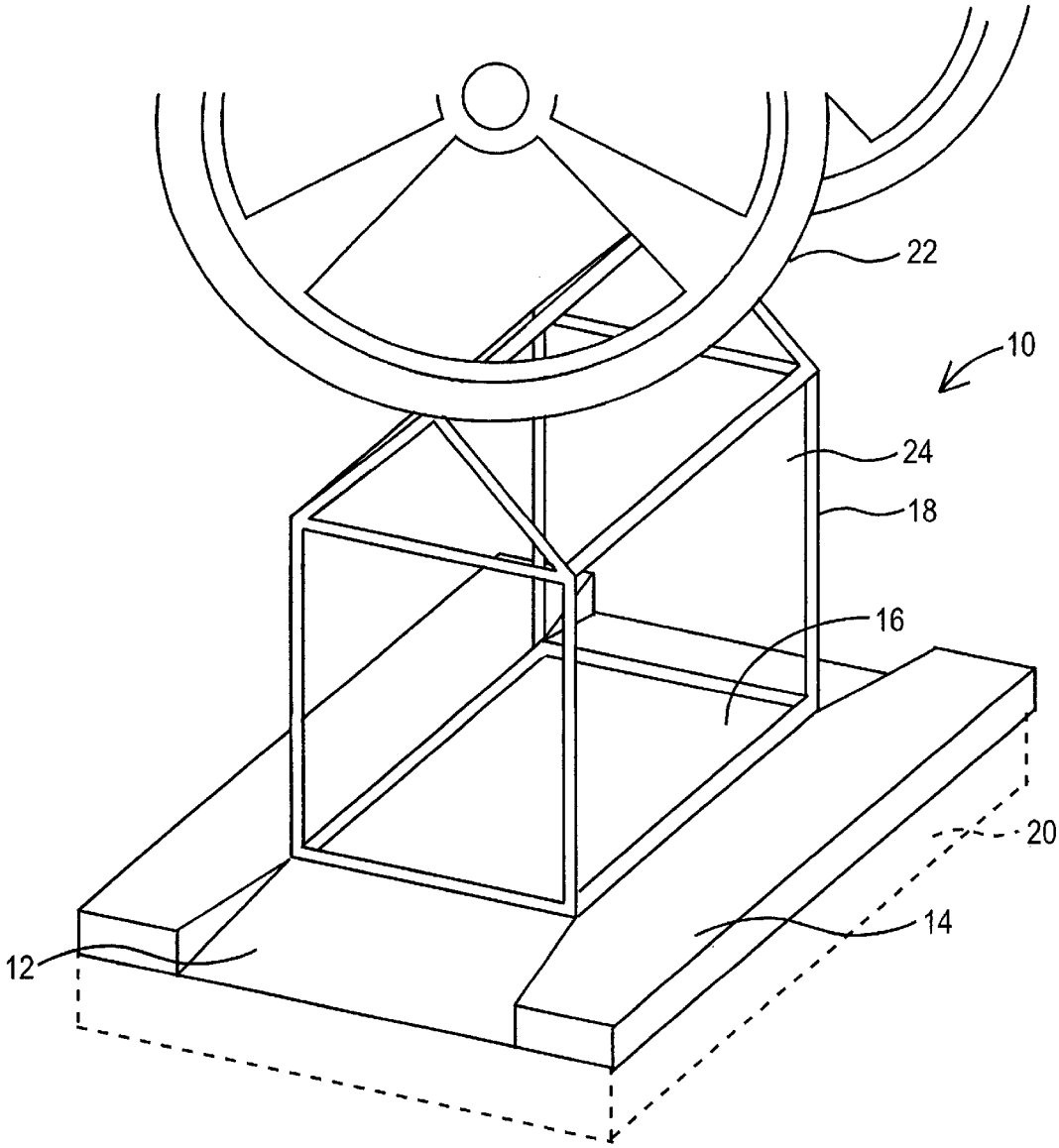
FIG. 1 illustrates a partially schematic perspective view of a system in accordance with the invention.

FIG. 1 partially schematically illustrates the bottom portion of a vertical conveyor system 10 for vertically conveying containers or pans of various sizes.

FIG. 2 illustrates a problem created by the use of different sized containers. The distance θ between the top of the carousel conveyor 30 and the floor 32 of the garage or access station remains the same despite the size of the container. Therefore, tall containers 28 are flush with the floor 32, and an SUV has no problem accessing the pan of the tall container. However, when the carousel rotates and a short container 26 is presented for a shorter car, the pan of the short container 26 is suspended above the surface of the floor 32. To access the pan 16 (see FIG. 1) of container 26, the present invention offers a ramp 12.

Similarly, an elevated container presents a problem for passengers laterally accessing the pan or a vehicle on a pan. Hence, the present invention provides an access walkway 14. The walkway 14 allows passengers and drivers comfortably to step into their vehicles from a normal street-to-vehicle distance, or less. The walkway 14 also provides the advantage of access for the handicapped and, thus, is helpful accessing even a tall container.

Figure 3A:
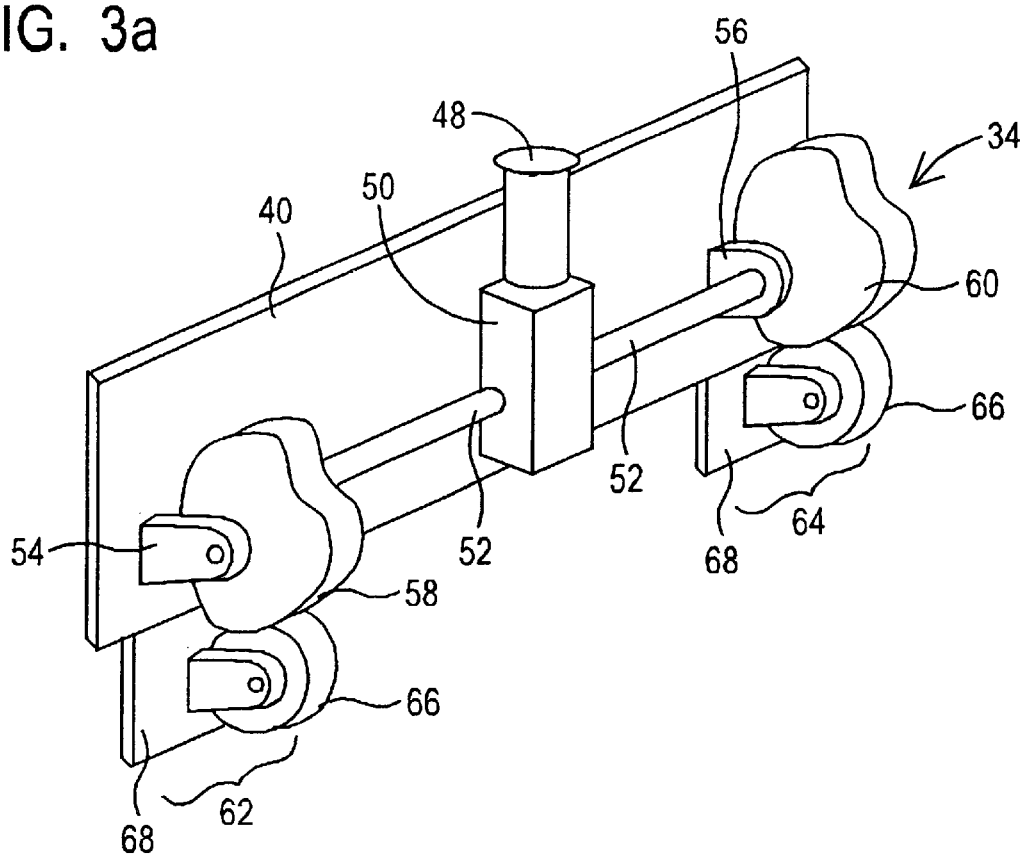
FIG. 3*a* is a partially schematic perspective view of a ramp-lifting assembly, with the ramp omitted.
Figure 3B:
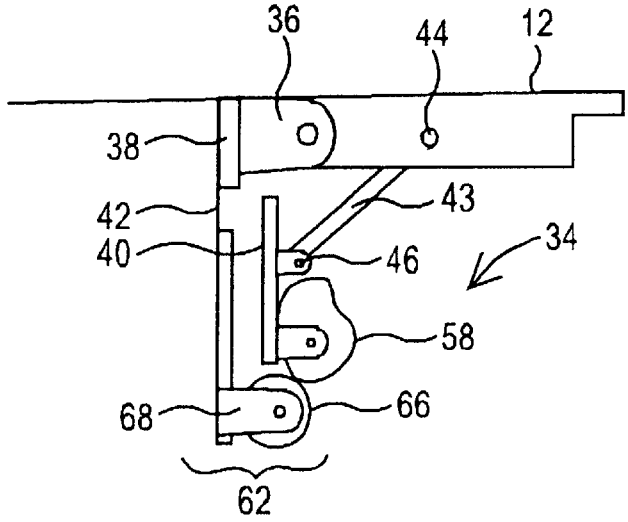
FIG. 3*b* is a partially schematic end view of the ramp-lifting assembly of FIG. 3*a;*

Installation of a ramp-lifting assembly 34, shown in FIGS. 3*a* and 3*b*, and a walkway-lifting assembly, shown in FIGS. 4*a* and 4*b*, includes placement of a pit 20 (see FIG. 1) below the containers 24. The dimensions of the pit are slightly larger than the dimensions of pan 16.

The ramp-lifting assembly 34 includes a ramp 12, extending across the width of pit 24. A ramp bracket 36 pivotally joins the ramp 12 to the top edge 38 of the ramp side wall, where the top edge meets the floor of the garage.

A carriage 40 is located inside the pit and is movably attached, parallel to the ramp side wall 42. A carriage ramp link 43 joins the carriage and the ramp. A first pivot 44 and second pivot 46 are used for attachment of the link. The first pivot 44 pivotally joins the carriage ramp link 43 to the ramp, and the second pivot 46 pivotally joins the carriage ramp link to the carriage.

A moving means for raising and lowering the ramp is located on the carriage 40. This means may be hydraulic or motorized. For illustrative purposes, here a motor 48 is used. The motor 48 is mounted in the approximate center of the carriage 40, and a speed reducer 50 is attached to motor 48. A drive shaft 52 is attached to the speed reducer 50. The motor 48 translates motion through the speed reducer 50, thereby rotating drive shaft 52. Another moving means might allow direct attachment to the drive shaft.

The drive shaft 52 extends approximately the length of the carriage 40, and is mounted to the carriage 40 at both ends by first and second drive shaft brackets 54, 56, respectively. These brackets 54, 56 aid in holding the drive shaft 52 onto the carriage 40. The drive shaft 52 rotates freely within the first and second drive shaft brackets 54, 56. First and second ramp cams 58, 60 are attached to opposite ends of the drive shaft 52. Mounted to the walkway side wall are first and second roller plates 62, 64. The roller plates 62, 64 include a roller 66 and a plate 68. The plate 68 mounts the roller plate 62, 64 to the wall, and the roller 66 rolls over the ramp cams 58, 60. A vertical conveyor system may have a single ramp where a vehicle enters and exits, or the system may have a ramp-lifting assembly at both ends, thereby allowing access or egress through either end of a container pan.

Figure 4A:
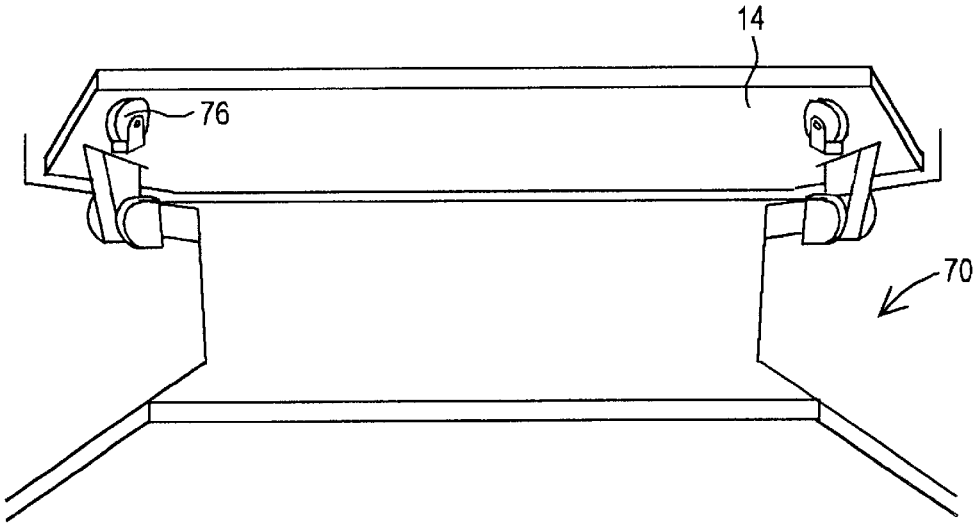
FIG. 4*a* is a partially schematic perspective view of a walkway-lifting assembly.
Figure 4B:
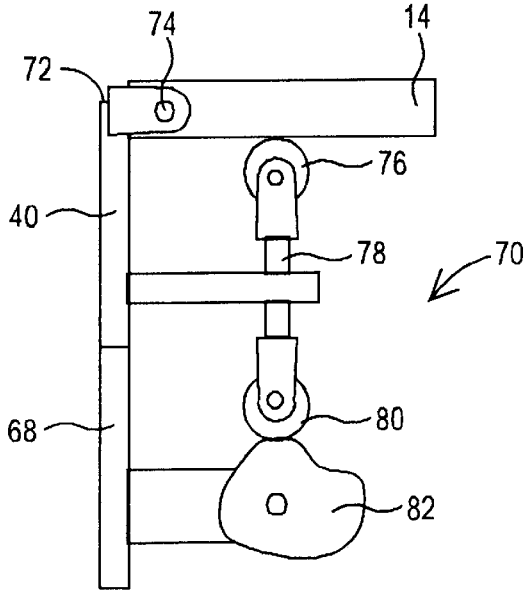
FIG. 4*b* is a partially schematic end view of a walkway-lifting assembly.

The vertical conveyor system also has a walkway-lifting assembly 70, shown in FIGS. 4*a* and 4*b*. The walkway-lifting assembly 70 serves similar purposes as the ramp-lifting assembly 34 discussed above. However, the mechanics of the walkway-lifting assembly 70 differ from those of the ramp-lifting assembly 34. The walkway-lifting assembly 70 includes a walkway 14 that may extend the entire length of the pit 20 (see FIG. 1). The walkway 14 is pivotally joined to the top edge 72 of the walkway side wall by a walkway bracket 74. A walkway roller 76 contacts the underside of the walkway. A walkway rod 78 is attached to the walkway roller 76, and the other end of the walkway rod is connected to a rod cam 80. The rod cam 80 contacts a walkway cam 82. Walkway cam 82 is attached to drive shaft 52 on ramp-lifting assembly 34. The carriage 40 is capable of lifting both a walkway 14 and a ramp 12, and the two structures are synchronously positioned.

The walkway lifting assembly 70 may also be configured with a walkway cam 82 that is shaped to cause movement of the walkway 14 in directions upwardly, downwardly, or in either of those directions to facilitate rotation of the walkway 14 out of its substantially horizontal elevation position, to a position that will permit entrance and exit of different individual containers as the vertical carousel rotates such containers into and out of the container access location. And, the cam 82 also can be configured to position a walkway 14 substantially horizontally at different desired heights to facilitate driver/passenger ingress/egress from vehicles of different height vis-a-vis the adjacent floor of the access area.

Similarly, the ramp-lifting assembly may be modified to position the ramp at various angles and heights vis-a-vis the horizontal to permit smooth transition of a vehicle from the fixed floor of the entrance/exit pit to the pan or platform of a container on the vertical carousel.

The combination of adjustably positionable ramp and adjustably positionable walkways permits the system of the present invention to accommodate containers and vehicles at varying heights, thereby rendering the inventive system extraordinarily user-friendly, regardless of the container height/vehicle height combination encountered. While the herein-described ramp lifting assembly and walkway lifting assembly are designed as motor-driven cam operated systems, it will be appreciated that other mechanical, pneumatic or hydraulic mechanisms may be designed to carry out the functions of the assemblies disclosed herein.

The pit also accommodates the mechanics of the walkway and ramp. Moreover, the pit makes possible additional enhancements to the vertical conveyor system.

The containers 24 positioned around the carousel 22 of the vertical conveyor system 10 include pans or platforms 16, which are suspended by supports or risers 18 (see FIG. 1). In the case of short containers, the supports are short. Likewise, tall containers have long supports. In a preferred embodiment, the ratio of short containers to tall containers will be equal, alternating short/tall around the carousel.

Figure 5:
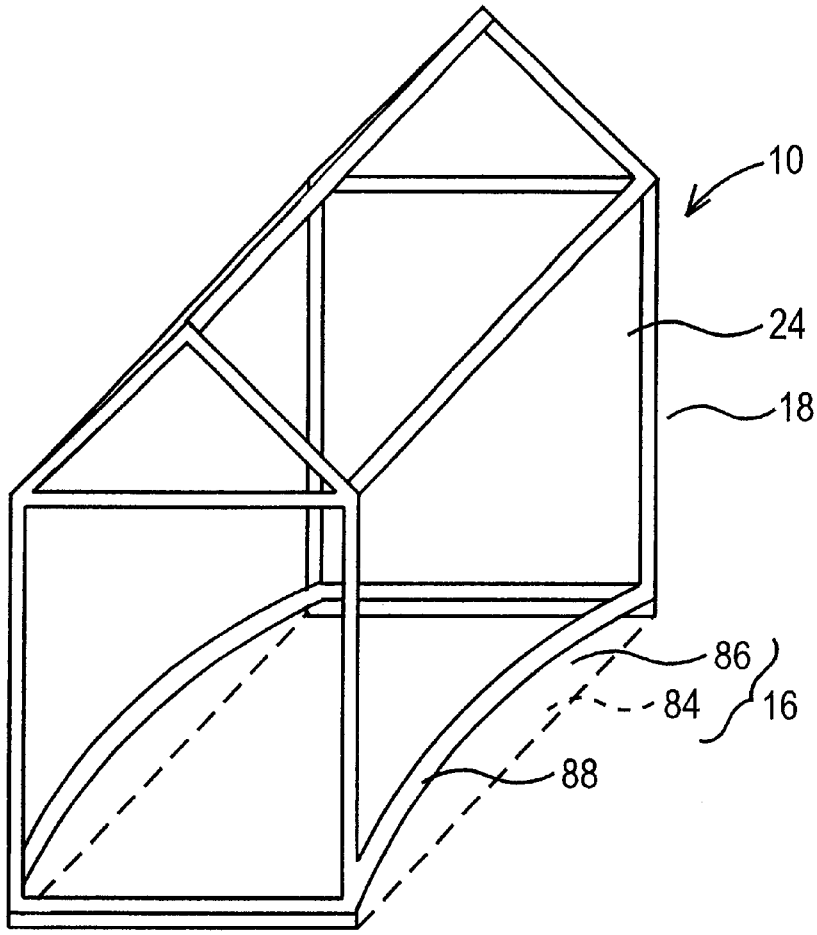
FIG. 5 is a partially schematic view of an individual container having its pan or platform curving upward in a fore/aft direction.

FIG. 5 shows a pan or platform 16 which assumes either an unloaded position 86, or a deflected, loaded position 84. The pan or platform 16 is arched or cambered upwardly when no load rests upon it, and flattened when loaded with a vehicle.

The platform 16 is configured to maintain control of any fluids that may leak from vehicles that the platform supports. These fluids may be water, melting snow or ice, antifreeze, oil, gasoline, transmission fluid, brake fluid, or the like. Since some such fluids may be flammable or explosive, they should not be captured or contained in a confined volume. Rather such fluids should simply be controlled in the open atmosphere.

Platform 16 includes around its periphery continuous rim 88 to contain fluids. This rim 88 also is designed to be compliant with the American Disabilities Act, enabling unimpeded use of the platform by handicapped persons in wheelchairs. In a preferred embodiment, the height and floor area of the rim are such that a flat, horizontal platform can hold approximately forty-six gallons of fluids. When that platform is tilted one inch from level, side to side, its liquid capacity decreases to thirty gallons. The shape of the unloaded, cambered platform results in a fluid holding capacity significantly less than the holding capacity when the same platform is loaded and flat.

During operation, the platform must be able to support vehicles that weigh up to about 5,500 lbs. The average vehicle is estimated to weigh approximately 4,000–4,500 lbs. Load/deflection data indicate that the platform will deflect one inch downward in the center under the weight of an average vehicle.

Figure 2A:
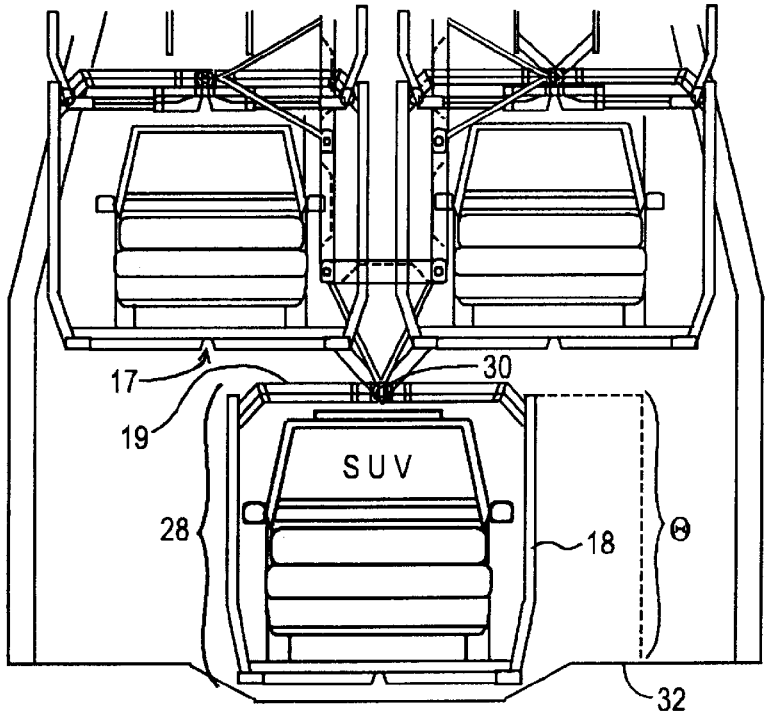
FIGS. 2*a* and 2*b* are partially schematic end views illustrating the access problem created by placing different sized containers around a vertical storage carousel.
Figure 2B:
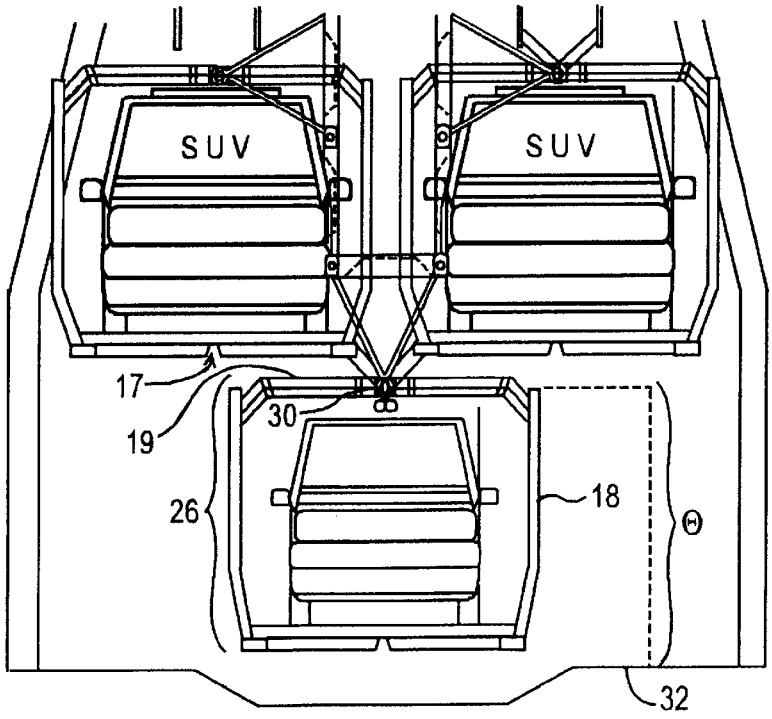

When being accessed, the platform 16 is positioned at the bottom, center of the carousel 22, as schematically illustrated in FIGS. 1, 2*a* and 2*b*. The platform 16 is positioned above pit 20 which holds the patron walkway 14 and ramp 12 actuator mechanisms 70 and 34 described above herein.

When a vehicle leaves the platform from this position, the platform reconfigures itself from the deflected, flat, horizontal position 84 to the unloaded, cambered upwardly position 86. In this condition, the platform has much less volumetric holding capacity and essentially discharges the bulk of any fluid therein into the pit as the vehicle leaves the platform. Approximately 75% of retained fluid volume may be discharged in this manner.

Furthermore, the platform drains itself at the preferred lowest position on the tower, without the need for active devices or drain plugs. When the next vehicle drives onto the platform, if there is no fluid released from it, there is a substantial surplus (75%) of fluid capacity which provides relatively drip-free movement of the platforms as they rotate around the tower. Draining the platform at the lowest position minimizes possible sloshing and splashing of falling fluids from moving platforms.

Figure 6A:
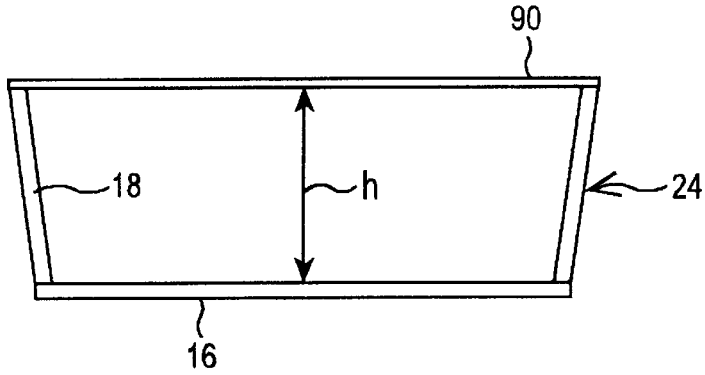
FIG. 6a PRIOR ART
FIG. 6*a* is a partially schematic side view of an individual prior art container.
Figure 6B:
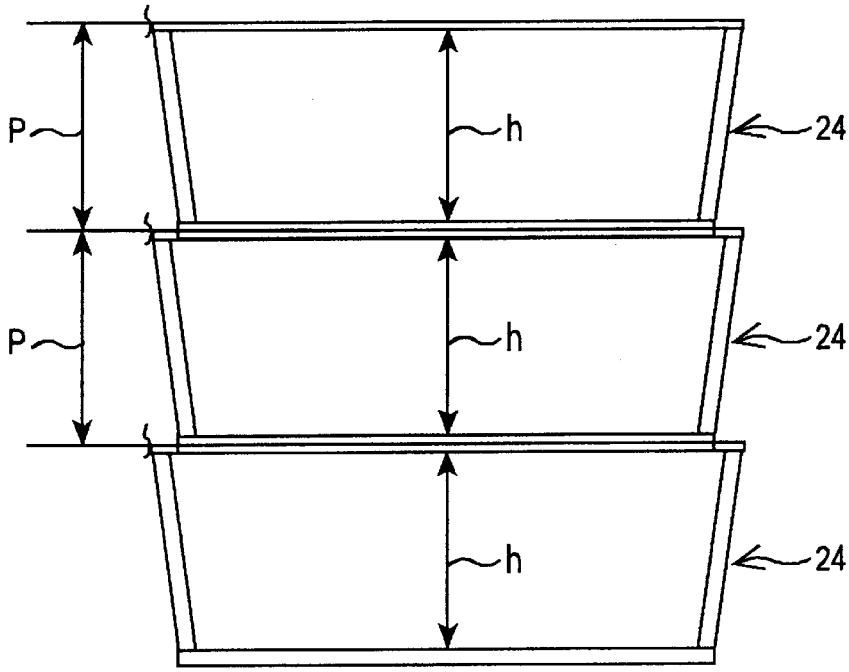
FIG. 6b PRIOR ART
FIG. 6*b* is a partially schematic side view of a plurality of prior art containers in vertically aligned relationship as on a vertical carousel.

FIGS. 6*a* and 6*b*, respectively, are partially schematic side views of containers in prior art vertical carousel systems. FIG. 6*a* schematically illustrates a side view of a prior art individual container showing the individual container having a standard height, typically about 75 inches between bottom pan or platform 16 and upper spreader bar 90. Also illustrated in FIG. 6*a* are supports or risers 18, which when viewed from the side as in FIG. 6*a*, rise obliquely outwardly from each end of pan 16 upwardly in the direction of spreader bar 90. As shown in FIGS. 2*a* and 2*b*, such supports or risers 18, when viewed from the end of an individual container, rise substantially vertically from pan or platform 16 to a shoulder member 19 which has a substantially horizontal section with downwardly sloping shoulder portions at each end where the shoulder member 19 connects with the top portions of risers 18. Spreader bar 92 then extends in the lengthwise direction of the container from the center of the shoulder member at one end to the center of the shoulder member at the other end.

FIG. 6*b* schematically illustrates a plurality of the prior art containers in their vertically aligned relationship as in prior art vertical carousels. As shown in FIG. 6*b*, each of the plurality of prior art containers 24 has dimensions identical to the dimensions of the other containers so that all containers 24 have the same height h and the pitch distance P between the pivot points where the centers of the shoulder members 19 to which the risers 18 and spreader bar 90 are attached, are pivotally mounted to the vertical carousel drive loop. It will be appreciated from all of FIGS. 1, 2*a*, 2*b*, 5, 6*a*, 7*a*, and 7*b*, that in various embodiments the risers 18 may be straight, as illustrated, for example, in FIGS. 1 and 5, or may have curved lower portions, or other portions, as illustrated, for example, in FIGS. 2*a* and 2*b*.

Figure 7A:
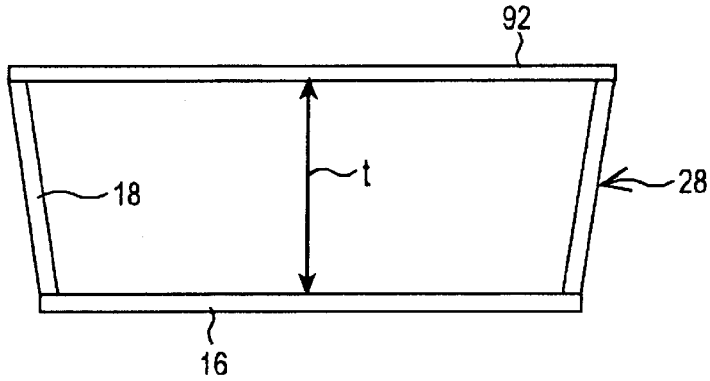
FIG. 7*a* is a partially schematic side view of an individual tall container according to the present invention.

FIG. 7*a* is a partially schematic side view of a tall container 28 in accordance with the present invention. The tall container 28 has fundamentally the same side view shape as the prior art container 24 illustrated in FIG. 6*a*, but the height t of tall container 28 illustrated in FIG. 7*a* is substantially longer than the standard height h of prior art container 24 illustrated in FIG. 6*a*. In the present invention, height t is typically on the order of about 81 inches, as compared with prior art height h of about 75 inches.

Figure 7B:
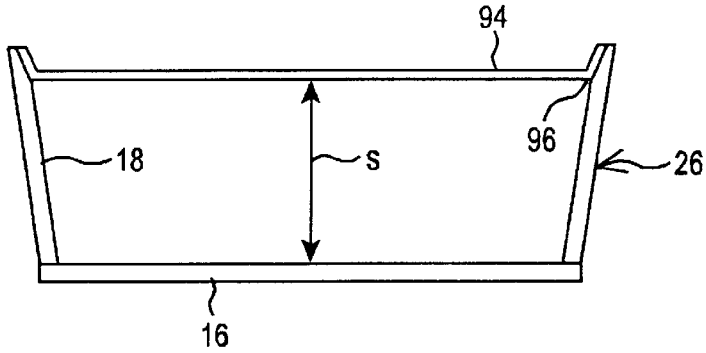
FIG. 7*b* is a partially schematic side view of an individual short container according to the present invention.

FIG. 7*b* is a partially schematic side view of a short container 26 in accordance with the present invention. In short container 26 height s is substantially less than the normal height h of prior art containers 24 as illustrated in FIG. 6*a*. In the present invention, height s is on the order of about 69 inches, as compared with normal height h of about 75 inches in prior art containers 24. This lesser height s between pan or platform 16 and spreader bar 94 as illustrated in FIG. 7*b* is achieved by making the connection between each end of spreader bar 94 and the horizontal shoulder member 19 joining risers 18 at each end of the container locate spreader bar 94 in a lower position vis-a-vis both the shoulder members 19 and pan or platform 16. As illustrated in FIG. 7*b*, each end of spreader bar 94 is shown with a bend therein so that the bent end portion of the spreader bar 94 connects the horizontal central portion thereof to the shoulder member 19 at each end of container 26. Alternatively, the spreader bar 94 itself could be straight, and other forms of mechanical joints could be used to connect the ends of a straight spreader bar 94 to the shoulder member at each end of the container 26.

Figure 7C:
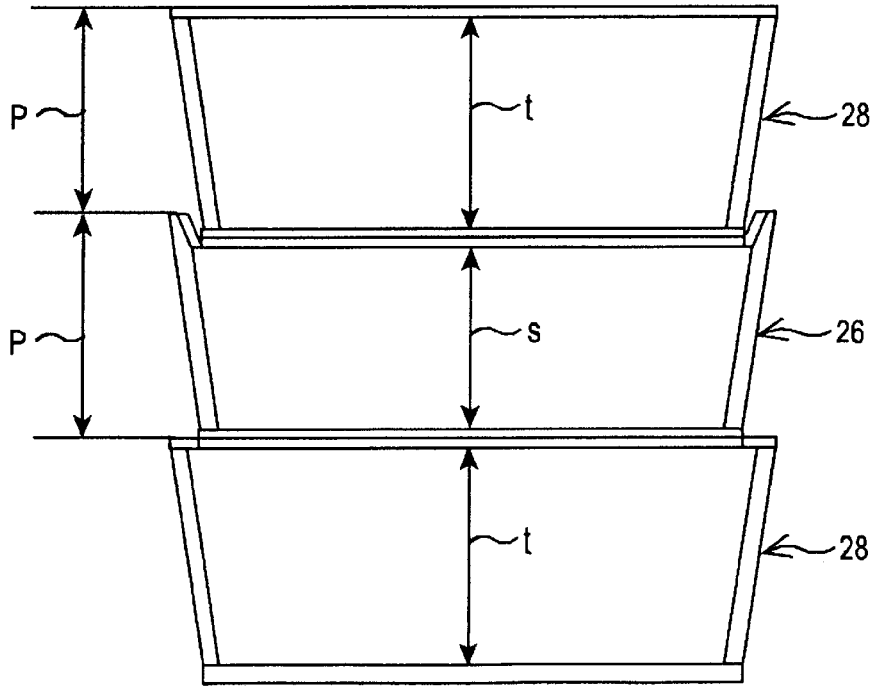
FIG. 7*c* is a partially schematic side view of a plurality of alternating tall/short/tall containers in vertically aligned relationship as on a vertical carousel embodying the present invention.

FIG. 7*c* then illustrates a plurality of alternating tall/short/tall containers arranged as they appear in a vertical carousel in the present invention. It will be appreciated from the partially schematic side view of FIG. 7*c* that the tall height t of upper container 28 causes the lower pan or platform 16 of that tall container to be nested in the space provided by the lower spreader bar 94 on immediately adjacent shorter container 26. However, the pitch distance P between the points of pivotal connection of the shoulder members 19 of each container to the vertical carousel drive loop remains constant, as shown in both the system of the present invention schematically illustrated in FIG. 7*c* and the prior art system schematically illustrated in FIG. 6*b*.

The end views of individual pans or platforms appearing in FIGS. 2*a* and 2*b* additionally illustrate a notch 17 in the lower surface of each pan or platform 16, which notch 17 fits over the spreader bar of the immediately lower adjacent container when the containers are vertically aligned as illustrated in FIG. 6*b* or 7*c*. It will be appreciated that the nesting of each spreader bar in the notch 17 in the exterior of the immediately higher adjacent pan or platform 16 provides side-to-side stability for each platform when raised on the vertical carousel in the positions illustrated in FIG. 7*c*, for example.

To operate the vertical conveyor system a user first selects a container to access. The carousel rotates, presenting the selected container at an accessible position. Generally, this position is at the bottom of the carousel. Next, the walkway and ramp are moved into position. The height of the container may dictate the positioning of the walkway and ramp. A conveyor system of the present invention normally includes both short and tall containers. Therefore, the ramp and walkways will move into one of at least two accessible positions, either a short container accessible position, or a tall container accessible position. With the ramps and walkways in position, patrons may access a vehicle on the pan of the container. To allow access to other containers, the carousel once again rotates. However, before doing so, the walkway and ramps are moved into neutral positions. For the walkway, the typical neutral position is within the pit. The ramp, however, usually moves upward into a substantially vertical orientation. Thus, a walkway and ramp each typically have three possible positions: a neutral position, a short container accessible position, and a tall container accessible position.

While the advantageous vertical conveyor of the present invention has been illustrated in specific preferred embodiments herein, those skilled in the art will understand that various modifications of the advantageous device of the present invention may be made without departing from the scope and spirit of the invention as stated in the following claims.

What is claimed is:

1. A vertical conveyor system, comprising:

a vertically extending frame;

an endless carousel type conveyor drive loop supported on the vertically extending frame;

a plurality of conveyor containers pivotally connected to the drive loop, wherein the pitch spacing distance along said drive loop between pivotal connections for adjacent containers among said plurality of containers is substantially constant; and wherein said plurality of conveyor containers comprises at least one pair of adjacent short and tall containers, respectively.

2. The vertical container system of claim 1, wherein the entire plurality of conveyor containers consists of alternating adjacent short and tall conveyor containers.

3. The vertical conveyor system of claim 1, wherein each conveyor container comprises a lower container pan supported at each end by equal length riser members connected at or near the corners of said container pan and rising to a shoulder member extending across the width of the container, and a spreader bar extending lengthwise between the shoulder members, each shoulder member at its center being pivotally connected to the conveyor drive loop;

the height distance between the pan and spreader bar of a short container being shorter than said height distance of a tall container.

4. The vertical conveyor system of claim 2, wherein all short containers have the same height distance (s) and all tall containers have the same height distance (t).

5. The vertical conveyor system of claim 1, additionally comprising:

an access station at the bottom of the drive loop, comprising a floor having a pit therein wherein the pit is bounded by front and back ramps and a pair of substantially parallel walkway side walls;

a ramp-lifting assembly attached to at least one of the ramps;

a walkway-lifting assembly attached to at least one of the walkway sidewalls;

the access station being positioned so that movement of the carousel conveyor drive loop will cause said containers to enter and exit said station with a container pan located between the planes of the walkway sidewalls.

6. The vertical conveyor system of claim 5, wherein the ramp-lifting and walkway-lifting assemblies each have a means for positioning each assembly in a plurality of predetermined positions.

7. The vertical conveyor system claim 6, the ramp-lifting assembly further comprising:

a ramp having an underside and topside, the ramp extending lengthwise across the width of the pit;

a ramp bracket pivotally joining the ramp to the top edge of a ramp-side wall;

a carriage movable and attached parallel to the ramp-side wall;

a carriage-ramp link joining the carriage to the ramp;

first and second linking brackets, the first bracket pivotally joining the carriage-ramp link to the ramp, and the second bracket pivotally joining the carriage-ramp link to the carriage;

a motor mounted on the carriage;

a speed reducer attached to the motor;

a drive shaft comprising first and second ends, the drive shaft attached to the motor, the drive shaft extending approximately the length of the carriage;

first and second drive shaft brackets, attached to the carriage, the drive shaft rotating freely within the first and second drive shaft brackets;

first and second ramp cams, each ramp cam attached to opposite ends of the drive shaft where the ends exit the drive shaft brackets; and first and second roller plates, each roller plate comprising a roller and a plate, wherein a plate is mounted to a walkway-side wall and the roller rolls over a ramp cam.

8. The vertical conveyor system of claim 7, wherein the motor is mounted approximately in the center of the carriage, and a speed reducer is attached in the motor and the drive shaft.

9. The vertical conveyor system of claim 7, wherein the motor is an hydraulic actuator.

10. The vertical conveyor system of claim 6, wherein the ramp-lifting assembly is associated with the back ramp-side wall.

11. The vertical conveyor system of claim 6, further comprising a second ramp-lifting assembly, wherein one wall is associated with the ramp-lifting assembly, and the other ramp side wall is associated with the second ramp-lifting assembly.

12. The vertical conveyor system of claim 6, the walkway-lifting assembly further comprising:

a walkway comprising an underside and a topside, and extending the length of the pit;

a walkway bracket pivotally joining the ramp to the top edge if the walkway side wall;

a walkway roller contacting the underside of the walkway;

a walkway rod having first and second ends, the walkway roller attached to the first end of the rod;

a rod cam attached to the second end of the walkway rod; and a walkway cam attached to the drive shaft, whereby the rod cam contacts the walkway cam.

13. The vertical conveyor system of claim 6, further comprising a second walkway-lifting assembly, wherein one walkway side wall secures the walkway-lifting assembly, and the other walkway side wall secures the second walkway lifting assembly.

14. The vertical conveyor system of claim 3, wherein a container pan is cambered upwardly in its unloaded state.

15. The vertical conveyor system of claim 14, wherein said container pan further comprises a rim for holding fluids in the pan.

* * * * *